US006589392B1

(12) United States Patent
Skinner et al.

(10) Patent No.: US 6,589,392 B1
(45) Date of Patent: Jul. 8, 2003

(54) MULTICOMPONENT MONOFILAMENT FOR PAPERMAKING FORMING FABRIC

(75) Inventors: David B. Skinner, Columbia, SC (US); Atiye E. Tanverdi, Columbia, SC (US)

(73) Assignee: Shakespeare Company LLC, Columbia, SC (US)

( * ) Notice: Subject to any disclaimer, the term of this patent is extended or adjusted under 35 U.S.C. 154(b) by 0 days.

(21) Appl. No.: 09/982,478

(22) Filed: Oct. 18, 2001

(51) Int. Cl.[7] ..... D21F 1/10; D03D 3/04; D03D 15/08

(52) U.S. Cl. ..... 162/348; 162/903; 442/200; 442/217; 139/420 A; 260/DIG. 23

(58) Field of Search ..... 162/200, 207, 162/348, 306, 381, 358.1, 358.2, 358.4, 900–904; 139/383 A, 425 A, 383 AA, 420 A; 34/111, 116, 123; 428/357, 364, 373, 374, 370, 394, 395; 442/199, 191, 200, 217, 201, 361–364, 334, 335; 264/172.11, 172.13, 172.14, 172.15, 172.17; 260/DIG. 23; 528/272

(56) References Cited

U.S. PATENT DOCUMENTS

| | | | | | |
|---|---|---|---|---|---|
| 3,594,266 | A | * | 7/1971 | Okazaki et al. | 428/374 |
| 3,652,713 | A | * | 3/1972 | Okazaki et al. | 524/140 |
| 4,145,473 | A | * | 3/1979 | Samuelson et al. | 428/373 |
| 4,942,875 | A | * | 7/1990 | Hlavacek et al. | 606/230 |
| 5,082,720 | A | * | 1/1992 | Hayes | 442/362 |
| 5,169,711 | A | * | 12/1992 | Bhatt et al. | 442/199 |
| 5,502,120 | A | | 3/1996 | Bhatt et al. | 525/440 |
| 5,617,903 | A | * | 4/1997 | Bowen, Jr. | 139/383 A |
| 5,753,351 | A | * | 5/1998 | Yoshida et al. | 428/196 |
| 5,837,179 | A | * | 11/1998 | Pihl et al. | 264/172.11 |
| 5,888,915 | A | * | 3/1999 | Denton et al. | 442/200 |
| 5,948,529 | A | | 9/1999 | Hastie | 428/373 |
| 6,207,600 | B1 | | 3/2001 | Nakajima et al. | 442/311 |
| 6,254,987 | B1 | | 7/2001 | Delker | 428/373 |
| 6,270,891 | B1 | | 8/2001 | Maugans et al. | 428/364 |

OTHER PUBLICATIONS

Paper Machine Clothing, Section 2.2, pp. 37–92, SABIT ADANUR, Technomic Publishing, Inc, Lancaster, PA, 1997.

* cited by examiner

*Primary Examiner*—Peter Chin
*Assistant Examiner*—Eric Hug
(74) *Attorney, Agent, or Firm*—Renner Kenner Greive Bobak Taylor & Weber

(57) ABSTRACT

A melt-extruded multicomponent monofilament having good abrasion resistance, flex-fatigue toughness and dimensional stability. The monofilament is particularly suitable for use in the manufacture of papermaking machine forming fabrics, and includes an outer region component comprising polyethylene terephthalate and an inner region component comprising a blend of polyetherester block copolymer and polyethylene terephthalate.

22 Claims, 1 Drawing Sheet

MULTICOMPONENT MONOFILAMENT FOR PAPERMAKING FORMING FABRIC

BACKGROUND OF THE INVENTION

This invention relates to a melt-extruded multicomponent monofilament having improved abrasion resistance and toughness, while maintaining its excellent dimensional stability properties. The monofilament is particularly suitable for use in the manufacture of papermaking machine forming fabrics.

In a papermaking machine, a continuous sheet of paper or paper-like material is formed by flowing a water-based slurry of cellulosic fibers onto a traveling continuous woven belt. This woven belt is known in the art as a forming fabric. As the slurry travels on the continuous belt, much of the water is removed, creating a wet paper web. Water removal is accomplished by the use of hydrofoils, table rolls, and suction boxes. A typical slurry can originally contain as little as 0.5 percent by weight of cellulosic fibers, can range in temperature from about 30° C. to about 85° C., and can have a pH of from 4 to 9. The wet paper web may contain 80 percent by weight water as it leaves the forming section and enters the press section.

After leaving the forming section over a couch roll, the web is transferred to a press section where a major proportion of the remaining water is removed by passing it through a series of pressure nips in sequence. On leaving the press section, the web passes to a heated dryer section for final drying. The dried web can then be calendered, to smooth the surface, and then finally collected on a reel.

Conventional forming fabrics used in the forming section of a papermaking machine are based on synthetic plastic fibers, commonly called monofilaments. For a paper machine forming fabric to be useful, it should have good abrasion resistance, toughness, and dimensional stability. It must be resistant to abrasion from contact with machine parts and from contact with solids in the cellulose fiber-water slurry. Thus, abrasion resistance refers to both the resistance against wearing of the monofilament as well as its resistance to cuts, chaffing, etc. In the same way, the monofilaments of the forming fabrics must be tough. Particularly, the monofilament must have a high degree of flex-fatigue toughness. The forming fabric must be structurally stable in the plane of the fabric, in order to cope with the stresses imposed on it during use, but also must resist stretching under the tension imposed by the powered rolls which drive the fabric in a paper making machine. It must be dimensionally stable and resist any dimensional changes in the plane of the fabric due to moisture absorption over a wide range of moisture contents, because when the machine is running it will be fully wet, and when the machine is stopped for any length of time it will dry out. Finally, the forming fabric must be resistant to degradation by various materials present in the cellulose fiber-water slurry, and in materials used to clean the forming fabric, at the prevailing temperature of use.

No known fabric exhibits perfectly all of these characteristics. The synthetic polymers which provide the currently most acceptable monofilaments used in making forming fabrics are polyesters, particularly polyethylene terephthalate, and polyamides, particularly nylon-6 (polycaprolactam) and nylon-66 (polyhexamethyleneadipamide). These polymers have been mixed with others, such as polyethylene and polybutylene terephthalate, but still such fabrics are far from perfect.

Polyethylene terephthalate shows good chemical and dimensional stability, and also is amenable to weaving, having good crimpability, and exhibiting good heat set behavior, but its abrasion resistance leaves something to be desired, especially with higher speed modern machines.

Nylon-6 and nylon-66 show great abrasion resistance, but they have serious deficiencies for weaving because they have very poor crimpability and inadequate heat set behavior, and they possess neither adequate dimensional stability in the moisture range found in the papermaking environment, nor adequate resistance to some of the materials used in cleaning forming fabrics.

Attempts have been made in the art to combine polyester monofilaments and nylon monofilaments to obtain the advantages of each type of polymer. The inherent dimensional instability of nylon-6 and nylon-66 in the range of moisture contents found in the papermaking environment, however, running from fully wet to dry, imposes a restriction on the ratio of the number of nylon monofilaments to polyethylene terephthalate monofilaments which may be successfully used in forming fabrics.

Forming fabrics have also been prepared from monofilaments comprising blends of synthetic polymers. Two or more polymers are physically blended, and then melt-extruded to form monofilaments. Monofilaments have been described as consisting of a blend of from more than 60% to 90% by weight of polyethylene terephthalate polyester, from less than 40% by weight of a thermoplastic polyurethane, and from zero to about 5% by weight of a hydrolysis stabilizer. The disadvantage of blends is that the properties of the individual polymers are compromised when they are blended. For example, a blend containing only 60% by weight polyethylene terephthalate will not have the dimensional stability of pure polyethylene terephthalate.

A forming fabric comprising monofilaments having good abrasion resistance, toughness, and dimensional stability is desirable.

SUMMARY OF THE INVENTION

The present invention provides a melt extruded multicomponent monofilament comprising (a) an outer region comprising polyethylene terephthalate or a copolyester comprising at least about 80 mole percent of ethylene terephthalate units; and (b) an inner region comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

Using the above-described monofilament, a forming fabric for a papermaking machine can be made. Such a fabric comprises a plurality of melt-extruded multicomponent monofilaments comprising: (a) an outer region component comprising polyethylene terephthalate or a copolyester comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

In a preferred embodiment, the present invention further provides a forming fabric for a papermaking machine wherein the fabric comprising filaments woven in at least two directions. The at least two directions includes at least one layer of machine direction filaments and at least one layer of cross-machine direction filaments. Preferably, at least the cross-machine direction filaments comprise melt-extruded multicomponent monofilaments comprising: (a) an outer region component comprising polyethylene terephthalate or a copolyester comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

Advantageously, the monofilament of the present invention has improved properties of abrasion resistance and toughness when compared to conventional monofilaments made from polyester and copolyester blends. In addition, the monofilament of the present invention exhibits dimensional stability properties at least equivalent to conventional monofilaments made from polyester and copolyester blends. These characteristics render the monofilament of the present invention particularly suitable for use in papermachine forming fabric.

DETAILED DESCRIPTION OF THE INVENTION

Figure 1:
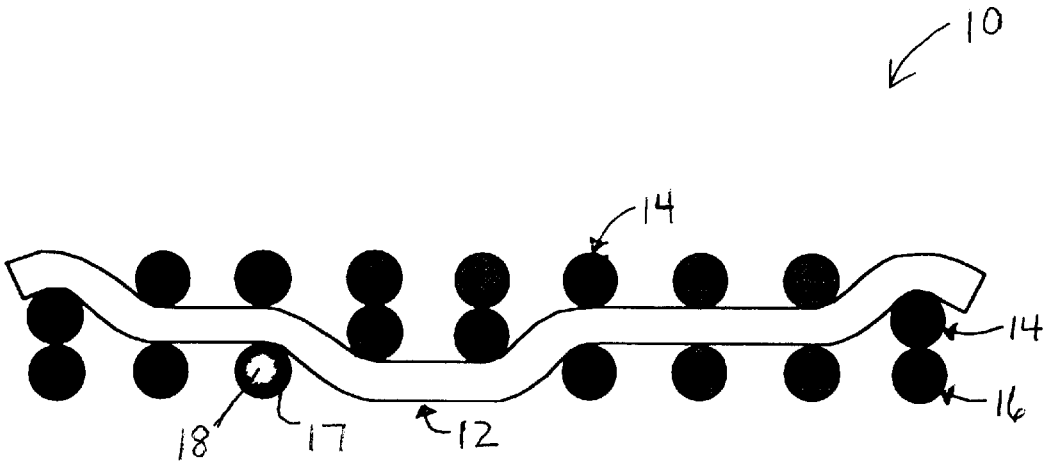
FIG. 1 is a partially schematic cross-sectional view of a two layer forming fabric.

The present invention is directed to a melt extruded multicomponent monofilament comprising (a) an outer region component comprising polyethylene terephthalate or a copolymer comprising at least about 80 mole percent of ethylene terephthalate; and (b) an inner region component comprising a blend of from about 1 to about 20 percent by weight of a polyetherester block copolymer and from about 80 to about 99 percent by weight of polyethylene terephthalate.

For consistency throughout the specification, several definitions are provided herein to distinguish various filaments. To that end, a filament is a fiber of an indefinite or extreme length. As used in this specification, the term "monofilament" refers to any single filament of a manufactured fiber. In contrast, the term "multifilament" refers to a filament consisting of many continuous filaments or strands, such as yarn. A "multicomponent monofilament", sometimes called a composite filament, is composed of two or more polymers that are co-extruded in such a manner that each polymer occupies a discrete region that runs the length of the filament. A cross-section of a multicomponent filament evidences a heterogeneous appearance consisting of two or more discrete regions. Where a multicomponent monofilament consists of two or more discrete regions, the monofilament is sometimes referred to as bicomponent. In contrast, a "multiconstituent monofilament" refers to a fiber extruded from a homogeneous mixture of two or more different polymers, as in a polymer blend. A cross-section of a multiconstituent filament evidences a homogeneous appearance with no discrete regions of heterogeneity. A "monoconstituent monofilament", which also evidences a homogeneous cross-section, comprises primarily only one polymer, although it may further comprise additives and modifiers which would not substantially affect the nature of the polymer.

Multicomponent monofilaments can be characterized according to the manner in which the discrete regions of the polymer components are arranged in relation to each other. For example, the polymer components may have a side-by-side arrangement, or an outer-inner arrangement. In the outer-inner arrangement, one of the polymer components is located substantially toward the periphery of the monofilament, in what shall be called an outer region, while the other polymer components are located in the inner region of the monofilament. Examples of outer-inner arrangements in multicomponent monofilaments include a sheath-core arrangement, and an islands-in-the-stream arrangement, among others. Examples of outer-inner arrangements of three polymer components in a multicomponent monofilament include a sheath-mantle-core arrangement and an islands-in-the-stream arrangement, among others. The outer-inner arrangement of the monofilament can be symmetrical or asymmetrical. The melt-extruded monofilament of the present invention comprises an outer-inner arrangement of an outer region and at least one inner region. Preferably, the melt-extruded monofilament of the present invention comprises a sheath-core or sheath-mantle-core arrangement, wherein the sheath corresponds to the outer region, the core corresponds to an inner region, and the mantle, if present, corresponds to a second, distinct, inner region.

The monofilament may have a round or flattened shape, with smooth, serrated, or irregular edges. It may be multilobal, such as tri-lobal, tetra-lobal, penta-lobal, hexa-lobal, and the like. There is no requirement that the outer region completely encompass or surround the inner region. Thus, it will be understood that the monofilament may be "striped" with outer region material extending along the edges of the inner region of the monofilament parallel to the longitudinal axis. In one preferred embodiment, the melt-extruded monofilament comprises a sheath-core arrangement. The core or sheath each may have any cross-sectional configuration known in the art. For example, the core may have a round, rectangular, or multi-lobal cross-sectional configuration.

The outer region component of the multicomponent monofilament of the present invention comprises polyester. More specifically, the outer region component comprises polyethylene terephthalate or a copolyester containing at least 80 mole percent of ethylene terephthalate units. Suitable copolymerization units in said copolyester include isophthalic acids, isophthalic acids with a metal sulfonate group, bisphenols, neopentyl glycols, and 1,6-cyclohexanediols. Cyanide-containing copolymerization units are not preferred. It is to be understood that polyester, copolyesters, polyethylene terephthalate, and polyethylene terephthalate blends, as used throughout this specification, do not include polyurethanes. The polyester should meet the standard requirements of purity known in the art, and preferably the polyester should contain about 0.007 percent by weight of water. The polyester should also have a molecular weight similar to that of resins commonly used to provide warp and filling filaments yarns. Preferably, the polyester starting material has an intrinsic viscosity (IV) of about 0.80 to about 0.99. More preferably, the polyester starting material has an intrinsic viscosity (IV) of about 0.85 to about 0.99. Even more preferably, the polyester starting material has an intrinsic viscosity (IV) of about 0.90 to about 0.95. While the outer region component may have good abrasion resistance, it will not be as good as the abrasion resistance of the inner region component.

Examples of suitable commercially available grades of polyethylene terephthalate (PET) include, but are not limited to, Merge 1995 and 1993 (trademarks of Du Pont), which PET contain a processing aid and $TiO_2$ as colorant, Arnite A06-300 (a trademark of Akzo), Vituf 9504C (a trademark of Goodyear), and Tenite 10388 (a trademark of Eastman). Merge 1995 is most preferred.

The multicomponent monofilament of the present invention further comprises at least one inner region component. The inner region component has higher abrasion resistance and is considered tougher than the outer region component. It comprises a blend of polyester and a polyetherester block copolymer. Preferably, the polyester comprises polyethylene terephthalate or a copolyester containing at least 80 mole percent of ethylene terephthalate units. Cyanide-containing copolymerization units are not preferred. Suitable copolymerization units in said copolyester include isophthalic acids, isophthalic acids with a metal sulfonate group, bisphenols, neopentyl glycols, and 1,6-cyclohexanediols. Suitable polyethylene terephthalate is as described above for the outer region component. A preferred polyetherester block copolymer has the tradename Hytrel® and is available from E.I. Du Pont de Nemours & Co., Inc. As described above, Hytrel® is a polyether-ester block copolymer having "soft" and "hard" segments. The "soft" segments are multibutyleneoxyterephthalate blocks, while the "hard" segments contain butylene terephthalate or tetramethylene terephthalate units. Hytrel® grades are available having a range of hardnesses. Preferably, the polyetherester block copolymer utilized in the inner region component has a durometer hardness of from about 40 to about 90.

The amounts of polyetherester block copolymer and polyester used in the inner region component may vary, depending upon such factors as whether fillers or other additives are used. Preferably, the inner region component comprises from about 1 to about 20 percent by weight of polyetherester block copolymer, and from about 80 to about 99 percent by weight of polyester. More preferably, the inner region component comprises from about 3 to about 17 percent by weight of polyetherester block copolymer, and from about 83 to about 97 percent by weight of polyester. Even more preferably, the inner region component comprises from about 5 to about 15 percent by weight of polyetherester block copolymer, and from about 85 to about 95 percent by weight of polyester. The polyetherester block copolymer may be blended with the polyester by conventional techniques.

The inner region component and outer region component may each further comprise fillers, pigments, hydrolysis stabilizers, or other additives which do not affect the nature of the polymers employed. Fillers may include mineral fillers, salts, and clay. Exemplary fillers include silica, mica, carbon black, talc, and aluminum powder. In a preferred embodiment, the outer region component is devoid of Hytrel®. Preferably, both the inner region component and the outer region component are devoid of any polyurethanes.

Delamination is a common concern when multicomponent monofilaments are used. Adhesion between the outer and inner region materials can be improved by mechanical interlocking or by improving the chemical interaction between the regions. Mechanical interlocking can be conducted at the die head of the extrusion process, wherein outer and inner components can be separately extruded in such a manner that, upon forming monofilament, the components are mechanically locked to one another. For example, the outer region component may be extruded to include a triangular flange extending toward the inner region component, while the inner region component is extruded to include a complementary triangular recess for receiving the flange. It will be understood that many other techniques can be used to mechanically interlock the components.

Bonding of the outer and inner region components via chemical interaction can be achieved through a number of methods. For example, coupling agents may be incorporated into the composition of both of the extruded components. Alternatively, adhesive-type additives, such as polyamide terpolymers or dimer acid-based polyimides, can be added to one or both of the component materials. Still further, additives having ionic functionalities, such as nylon ionomers, can be added to one or both components.

In the present invention, delamination is not a substantial concern since both the inner and outer regions of the monofilament comprise, at least partially, the same component, i.e., polyester. It will be appreciated that significantly strong bonding occurs when the inner and outer regions comprise at least some and preferably, substantial amounts of the same material.

The melt-extruded multicomponent monofilaments of the present invention are spun using conventional fiber-forming equipment. Separate melt flows of the outer region and inner region polymer components may be fed to a conventional multicomponent spinnerette pack such as those described in U.S. Pat. Nos. 4,406,850, 5,162,074, 5,445,884 and 5,533,883, the entire disclosure of each patent being hereby incorporated by reference. The melt flows are combined to form extruded monofilaments having distinct outer and inner polymer regions. In a preferred embodiment, the multicomponent monofilament have distinct outer and inner polymer regions combined in a sheath-core arrangement.

It will be understood by those skilled in the art that the amount of outer region component material relative to the amount of inner region component material in the monofilament can be expressed in terms of percent volume. For example, the total volume of a multicomponent monofilament may comprise 50 percent outer region component, including any fillers or additives that may have been blended into the outer region component material, and 50 percent inner region component, including any fillers or additives that may have been blended into the inner region component material. Preferably, the monofilament of the present invention comprises from about 50 to about 93 percent by volume inner region component material, and from about 7 to about 50 percent by volume outer region component material. More preferably, the monofilament of the present invention comprises from about 70 to about 93 percent by volume inner region component material, and from about 7 to about 30 percent by volume outer region component material. Even more preferably, the monofilament of the present invention comprises from about 80 to about 90 percent by volume inner region component material, and from about 10 to about 25 percent by volume outer region component material.

The extruded fibers are quenched by conventional methods in order to solidify the fibers. It will be understood by those of ordinary skill in the art that the multicomponent monofilament of the present invention may be coated with one or more materials in order to facilitate handling and weaving. Suitable coating materials include antistatic agents and lubricants. The monofilaments may be combined to form a yarn bundle which is then wound on a suitable package.

The abrasion resistance and toughness of the melt extruded monofilament of the present invention, expressed as the percent tensile retention after 10,000 revolution wet and squirrel cage tests, is preferably greater than about 25%, more preferably greater than about 30%, and even more preferably greater than about 35%. This differs significantly from prior PET resins wherein the percentage is less than 25% and usually less than 20%.

Squirrel cage fatigue tests are conducted using a squirrel cage abrader which consists of twelve equally spaced carbon steel bars on an approximately 25.5 cm diameter bolt circle rotating about a common axis. Each bar is about 3.1 mm in diameter and about 60.5 cm long with its axis parallel to a central axis. Each polyester monofilament is tied to a microswitch by means of a slip knot and then draped over the bars and retensioned with a free hanging weight. The microswitch is pretensioned so that a maximum of about 36 cm of monofilament is contacted by the bars at any one time. The free hanging weights weigh 500 grams each, and up to twelve monofilament strands can be tested at one time. The bars rotate about the common axis at 160 rpm. After 10,000 revolutions, the tensile strength of the monofilament is tested, and compared to its initial tensile strength. Percent tensile retention of the monofilament was calculated according to the following formula:

$$\text{tensile retention} = \frac{\text{tensile strength (lbs) after 10,000 revolutions}}{\text{tensile strength (lbs) before test}} \times 100$$

This test may be performed with the monofilaments and cage dry or wet. When wet, the cage is positioned in a pool of water to wet the bars as it rotates. The monofilaments may also be soaked in water prior to hanging.

The intrinsic viscosity of the melt-extruded multicomponent monofilaments is at least about 0.735 when measured in a solvent comprising a 60:40 parts by weight mixture of phenol and 1,1,2,2-tetrachloroethane at 30° C. More preferably, the intrinsic viscosity of the melt extruded monofilament is at least about 0.78. Even more preferably, the intrinsic viscosity is at least about 0.82.

The melt-extruded multicomponent monofilament of the present invention has improved properties of abrasion resistance and toughness when compared to conventional monofilaments made from polyester and copolyester blends, while having dimensional stability properties equivalent to conventional monofilaments. These characteristics render the multicomponent monofilament of the present invention particularly suitable for use in papermachine forming fabric. Accordingly, the present invention also provides a forming fabric for a papermaking machine, the fabric comprising melt-extruded multicomponent monofilaments comprising (a) an outer region component comprising polyethylene terephthalate or a copolymer comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolymer comprising at least about 80 mole percent of ethylene terephthalate units. Utilization of the monofilament of the present invention is independent of the type of forming fabric or the form of weave used.

The forming fabric has three distinct functions. First, it must allow water to pass through its structure. Second, it must support, retain and form the sheet. Third, it must act as a conveyor belt transporting the sheet to the press section.

Forming fabrics have more effect on the final sheet properties than press or drying fabrics, and this makes their design very critical. As a result, the design and manufacture of forming fabrics require very special considerations and careful engineering. A more in-depth description of paper machine forming fabrics is given by Sabit Adanur in *Paper Machine Clothing*, Chap. 2, Technonic Pub. Co., Inc., Lancaster, Pa. (1997), hereby incorporated by reference in its entirety.

Forming fabrics preferably comprise filaments woven in at least two directions. A fabric can be woven by either flat weaving or endless weaving. Flat woven fabrics have to be joined to make an endless fabric for use on the paper machine. Warp direction on the weaving machine becomes machine direction (MD) on the paper machine and filling direction on the weaving machine becomes cross machine direction (CD) on the paper machine. In endless weaving, the fabric is woven as an endless belt. The warp direction on the weaving machine becomes the cross-machine direction (CD) on the paper machine and the filling direction on the weaving machine becomes the machine direction (MD) on the paper machine.

The term "machine direction" means a direction substantially parallel to the direction in which the forming fabric moves in the paper machine. Similarly, the term "cross-machine direction" means a direction substantially at a right angle to the machine direction, and in the plane of the fabric. It is known in the art to use filaments in the MD and CD directions having different properties: cross-direction filament should have good wear properties and toughness, and MD filament should have good load-bearing properties.

There are basically three types of forming fabric designs used in the papermaking industry: single layer, two layer and three layer. Single layer fabrics have one layer of MD filaments and one layer of CD filaments. These filaments may be the same or different. In forming fabrics having two or more layers, there may be one layer of MD filaments and two layers of CD filaments. These layers may be the same or different. There are variations of designs known in the art. In one design variation, there are three layers of CD filaments and one layer of MD filaments. All forming fabrics, whether single or multi-layer, have a top side, upon which the papermaking slurry is laid down, and a roll side, sometimes called the machine side, that comes into contact with the rolls, foils, and other machine elements. Consequently, the forming fabric may comprise top side filaments and roll side filaments, which may be the same or different. It may be advantageous if the top side filaments comprise extra-fine monofilaments. Preferably, the roll side filaments have good wear properties, including abrasion resistance and toughness.

Figure 2:
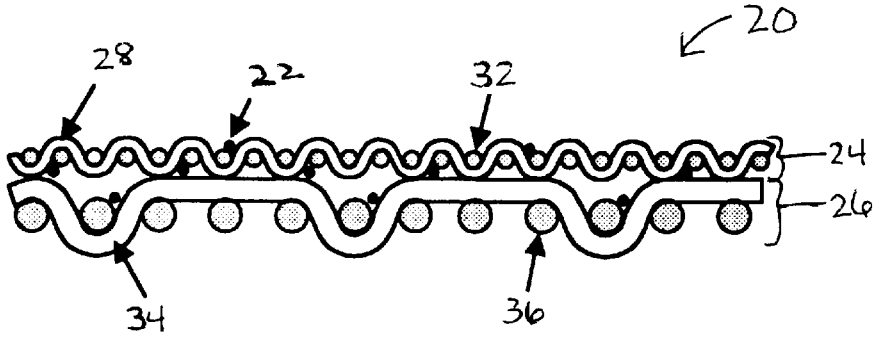
FIG. 2 is a partially schematic cross-sectional view of a three layer forming fabric.

Turning now to FIG. 1, a two layer forming fabric 10 is shown having MD filaments 12 interspersed among top side layer CD filaments 14 and roll side layer CD filaments 16. FIG. 2 shows a three layer forming fabric 20 in which stitches 22 are interspersed between top side layer 24 and roll side layer 26. Top side layer 24 contains top side layer MD filaments 28 and top side layer CD filaments 32. Roll side layer 26 contains roll side layer MD filaments 34 and roll side layer CD filaments 36.

As stated above, utilization of the multicomponent monofilament of the present invention in papermaking forming fabric is independent of the type of forming fabric or the form of weave used. It may be utilized as CD filament, MD filament, top side layer filament, roll side layer filament, or any combination thereof. As shown in one CD filament of FIG. 1, a bicomponent monofilament having a core 18 surrounded by a sheath 17 may be produced and used in the CD direction only (preferred) or in both the MD and CD directions. That is, it may be used in combination with other monofilaments known in the art for papermaking fabrics. Preferred monofilaments that may be used in combination with the multicomponent monofilament of the present invention comprise polyethylene terephthalate or polyethylene terephthalate blends. Preferably, these blends do not comprise polyurethane. The papermaking forming fabric may comprise a combination of two or more multicomponent monofilaments, all of which are within the scope of the present invention, but have different properties. The advantageous amount of monofilaments that comprise the melt-extruded multicomponent monofilament of the present invention varies depending upon a number of factors, including the type of forming fabric used, the number of layers, and the specific application.

In a preferred embodiment, the forming fabric of the present invention comprises filaments woven in at least two directions, wherein the at least two directions include at least one layer of machine direction filaments and at least one layer of cross-machine direction filaments. The MD filaments and the CD filaments may be the same or different. According to the present invention, at least one layer of the cross-machine direction filaments comprise a melt-extruded multicomponent monofilament comprising (a) an outer region comprising polyethylene terephthalate or a copolymer comprising at least about 80 mole percent of ethylene terephthalate units; and (b) an inner region comprising a blend of from about 1 to about 20 percent by weight of a polyetherester block copolymer and from about 80 to about 99 percent by weight of polyethylene terephthalate or a copolymer comprising at least about 80 mole percent of ethylene terephthalate units. Preferably, the balance of the filaments in the paper-making forming fabric comprise monoconstituent or multiconstituent monofilaments comprising polyethylene terephthalate or polyethylene terephthalate blends. The monoconstituent or multiconstitutent monofilaments preferably do not comprise polyurethane.

In a two layer forming fabric, as shown in FIG. 1, from about 50 to about 100% of the roll side CD filaments 16 of this preferred embodiment comprise melt-extruded multicomponent monofilament comprising (a) an outer region comprising polyethylene terephthalate or a copolymer comprising at least about 80 mole percent ethylene terephthalate units; and (b) an inner region comprising a blend of from about 1 to about 20 percent by weight of a polyetherester block copolymer and from about 80 to about 99 percent by weight of polyethylene terephthalate or a copolymer comprising at least about 80 mole percent ethylene terephthalate units, and from 0 to about 50% of the roll side CD filaments 16 comprise monoconstituent or multiconstituent monofilaments comprising polyethylene terephthalate or polyethylene terephthalate blends. In this embodiment, the balance of the filaments in the paper-making forming fabric preferably comprise monoconstituent or multiconstituent monofilaments comprising polyethylene terephthalate or polyethylene terephthalate blends.

In another preferred embodiment, the forming fabric of the present invention comprises three layers, as shown in FIG. 2. Preferably, from about 40 to about 100% of the roll side layer CD filaments 36 comprise melt-extruded multicomponent monofilament comprising (a) an outer region comprising polyethylene terephthalate or a copolymer comprising at least about 80 mole percent ethylene terephthalate units; and (b) an inner region comprising a blend of from about 1 to about 20 percent by weight of a polyetherester block copolymer and from about 80 to about 99 percent by weight of polyethylene terephthalate or a copolymer comprising at least about 80 mole percent ethylene terephthalate units, and from 0 to about 60% of the roll side layer CD filaments 36 comprise monoconstituent or multiconstituent monofilaments comprising polyethylene terephthalate or polyethylene terephthalate blends. In this embodiment, the balance of the filaments in the paper-making forming fabric preferably comprise monoconstituent or multiconstituent monofilaments comprising polyethylene terephthalate or polyethylene terephthalate blends.

In order to demonstrate the practice of the present invention, the following examples have been prepared and tested as described hereinbelow. The examples should not, however, be construed as limiting the scope of the invention. The claims will serve to define the invention.

EXAMPLES

In Example 1, a blend was prepared to contain 90% by weight polyethylene terephthalate and 10% by weight of a polyetherester block copolymer, namely Hytrel™ 5555HS. The block copolymer had a durometer hardness of 55. The blend was then melt-extruded with polyethylene terephthalate to form a multicomponent sheath-core monofilament having a sheath comprising polyethylene terephthalate and a core comprising the blend. The polyethylene terephthalate starting material utilized in both the sheath component and the core blend had an intrinsic viscosity of 0.95. The multicomponent sheath-core monofilament of Example 1 comprised about 10% by volume sheath component material and about 90% by volume core component material. In Table 1, these relative amounts are expressed as a sheath/core volume ratio. Therefore, the volume sheath/core ratio of the monofilament of Example 1 was 10/90. Physical properties of the resultant multicomponent monofilament are summarized in Table 1.

Example 2 was prepared as in Example 1, except that the volume sheath/core ratio of the monofilament was 20/80.

Example 3 is a comparative monoconstituent monofilament comprising polyethylene terephthalate having an intrinsic viscosity of 0.95. Examples 1, 2, and 3 were processed in the temperature range of about 550° F. to about 570° F. (287° C. to 299° C.). Comparative physical properties are summarized in Table 1.

To determine abrasion resistance and toughness, squirrel cage fatigue tests were conducted in a squirrel cage abrader which consists of twelve equally spaced carbon steel bars on an approximately 25.5 cm diameter bolt circle rotating about a common axis. Each bar is about 3.1 mm in diameter and about 60.5 cm long with its axis parallel to a central axis. Each polyester monofilament is tied to a microswitch by means of a slip knot and then draped over the bars and retentioned with a free hanging weight. The microswitch is pretensioned so that a maximum of about 36 cm of monofilament is contacted by the bars at any one time. The free hanging weights weigh 500 grams each, and up to twelve monofilament strands can be tested at one time. The bars rotate about the common axis at 160 rpm. After 10,000 revolutions, the tensile strength of the monofilament was tested, and compared to its initial tensile strength. Percent tensile retention of the monofilament was calculated according to the following formula:

$$\text{tensile retention} = \frac{\text{tensile strength (lbs) after 10,000 revolutions}}{\text{tensile strength (lbs) before test}} \times 100$$

These fatigue tests were performed both wet and dry.

The results of these above tests as well as other mechanical properties tested are shown in Table 1 wherein Example No. 3 is the control.

TABLE 1

Mechanical Properties of PET-based Monofilaments

| Example No. | 1 | 2 | 3 |
|---|---|---|---|
| Nominal Diameter (in) | 0.0098 | 0.0098 | 0.0098 |
| Sheath/Core Ratio | 10/90 | 20/80 | — |
| Tensile Strength (lbs) | 5.7 | 5.9 | 6.8 |
| Elongation @ Break (%) | 46.0 | 47.0 | 47.1 |
| Elongation @ 3.0 gpd (%) | 26.0 | 25.0 | 25.6 |
| Loop Strength (lbs) | 10.9 | 10.3 | 12.3 |
| Shrinkage @ 392° F. (%) | 3.0 | 3.2 | 2.68 |
| Tensile Retention, dry squirrel cage test (%) | 41.6 | 44.5 | 18.6 |
| Tensile Retention, wet squirrel cage test (%) | 38.0 | 43.0 | 22.8 |

As shown in Table 1, the multicomponent monofilaments of Examples 1 and 2, having an outer region comprising polyethylene terephthalate and an inner region comprising a blend of polyethylene terephthalate and a polyetherester block copolymer, maintain good physical properties and dimensional stability when compared to conventional monoconstituent monofilaments comprising polyethylene terephthalate. The flex fatigue toughness and abrasion resistance of the multicomponent monofilaments of Examples 1 and 2 was greatly improved over the comparative monofilament of Example 3. More specifically, the tensile retention of the multicomponent monofilaments of the present invention is significantly superior to the tensile retention of the comparative monofilament, after both wet and dry squirrel cage tests.

Although the present invention has been described in the above examples with reference to particular means, materials and embodiments, it would be obvious to persons skilled in the art that various changes and modifications may be made, which fall within the scope claimed for the invention as set out in the appended claims. The invention is therefore not limited to the particulars disclosed and extends to all equivalents within the scope of the claims.

We claim:

1. A melt-extruded multicomponent monofilament comprising:

(a) an outer region component comprising polyethylene terephthalate or a copolyester comprising at least about 80 mole percent of ethylene terephthalate units;

(b) a first inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units; and (c) a second inner region component, wherein the outer region component and the first and second inner region components are combined in a sheath-mantle-core arrangement.

2. The melt-extruded multicomponent monofilament of claim 1, wherein the outer region component comprises polyethylene terephthalate having an intrinsic viscosity of at least about 0.80 prior to extrusion.

3. The melt-extruded multicomponent monofilament of claim 1, wherein the blend comprises from about 3 to about 17 percent by weight of a polyetherester block copolymer and from about 83 to about 97 percent by weight of polyethylene terephthalate.

4. The melt-extruded multicomponent monofilament of claim 1, wherein the polyetherester block copolymer comprises:

(a) multibutyleneoxyterephthalate blocks; and (b) butylene terephthalate or tetramethylene terephthalate blocks.

5. The melt-extruded multicomponent monofilament of claim 1, wherein the blend is devoid of polyurethane.

6. The melt-extruded multicomponent monofilament of claim 1, wherein the blend comprises polyethylene terephthalate having an intrinsic viscosity of at least about 0.80 prior to extrusion.

7. The melt extruded multicomponent monofilament of claim 1, wherein the monofilament comprises from about 7 to about 50 percent by volume outer region component and from about 50 to about 93 percent by volume combined first inner region component and second inner region component.

8. A forming fabric for a papermaking machine, the fabric comprising:

melt-extruded multicomponent monofilaments comprising:

(a) an outer region component comprising polyethylene terephthalate or a copolyester comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

9. A forming fabric for a papermaking machine, the fabric comprising:

filaments woven in at least two directions, wherein the at least two directions include at least one layer of machine direction filaments and at least one layer of cross-machine direction filaments, and wherein the cross-machine direction filaments comprise melt-extruded multicomponent monofilaments comprising:

(a) an outer region component comprising polyethylene terephthalate or a copolyester comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

10. The forming fabric of claim 9, wherein the machine direction filaments comprise melt-extruded multicomponent monofilaments comprising:

(a) an outer region component comprising polyethylene terephthalate or a copolyester comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

11. The forming fabric of claim 9, wherein the machine direction filaments comprise monoconstituent or multiconstituent monofilaments comprising polyethylene terephthalate or a copolyester comprising at least about 80 mole percent of ethylene terephthalate units.

12. The forming fabric of claim 9, wherein the cross-machine direction filaments further comprise monoconstituent or multiconstituent monofilaments comprising polyethylene terephthalate or a copolyester comprising at least about 80 mole percent of ethylene terephthalate units.

13. The forming fabric of claim 12, wherein from 0 to about 50 percent of the cross-machine direction filaments comprise monoconstituent or multiconstituent monofilaments comprising polyethylene terephthalate or a copolyester comprising at least about 80 mole percent of ethylene terephthalate units.

14. The forming fabric of claim 9, wherein the at least one layer of cross-machine direction filaments comprises a top side layer and a roll side layer, and wherein the roll side layer of cross-machine direction filaments comprises melt-extruded multicomponent monofilaments comprising:

(a) an outer region component comprising polyethylene terephthalate or a copolyester comprising at least about 80 mole percent of ethylene terephthalate units; and (b) an inner region component comprising a blend of from about 1 to about 20 percent by weight of a polyetherester block copolymer and from about 80 to about 99 percent by weight of polyethylene terephthalate or a copolyester comprising at least about 80 mole percent of ethylene terephthalate units.

15. The forming fabric of claim 9, wherein the outer region component and the inner region component are combined in a sheath-core arrangement, and wherein the outer region component is a sheath component and the inner region component is a core component.

16. The forming fabric of claim 9, further comprising a second inner region component, wherein the outer region component and inner region components are combined in a sheath-mantle-core arrangement.

17. The forming fabric of claim 9, wherein the outer region component and the inner region component are combined in an islands-in-the-stream arrangement.

18. The forming fabric of claim 9, wherein the outer region component comprises polyethylene terephthalate having an intrinsic viscosity of at least about 0.80 prior to extrusion.

19. The forming fabric of claim 9, wherein the blend comprises from about 3 to about 17 percent by weight of a polyetherester block copolymer and from about 83 to about 97 percent by weight of polyethylene terephthalate.

20. The forming fabric of claim 9, wherein the polyetherester block copolymer comprises:

(a) multibutyleneoxyterephthalate blocks; and (b) butylene terephthalate or tetramethylene terephthalate blocks.

21. The forming fabric of claim 9, wherein the blend comprises polyethylene terephthalate having an intrinsic viscosity of at least about 0.80 prior to extrusion.

22. The forming fabric of claim 15, wherein the monofilament comprises from about 7 to about 50 percent by volume sheath component and from about 50 to about 93 percent by volume core component.

* * * * *